US007156537B1

(12) United States Patent
Cohrs

(10) Patent No.: US 7,156,537 B1
(45) Date of Patent: Jan. 2, 2007

(54) STRIP LIGHT SHADE

(76) Inventor: Marie Laverne Cohrs, 9954 S. Heywood, Highlands Ranch, CO (US) 80126

( * ) Notice: Subject to any disclaimer, the term of this patent is extended or adjusted under 35 U.S.C. 154(b) by 111 days.

(21) Appl. No.: 10/847,271

(22) Filed: May 17, 2004

(51) Int. Cl.
*F21S 8/00* (2006.01)

(52) U.S. Cl. ..... 362/147; 362/223; 362/351

(58) Field of Classification Search ..... 362/147, 362/223, 351, 355–357, 361, 433
See application file for complete search history.

(56) References Cited

U.S. PATENT DOCUMENTS

| | | | | |
|---|---|---|---|---|
| 1,272,524 | A | 7/1918 | Rabenold | |
| 1,768,800 | A * | 7/1930 | Steiner | 362/126 |
| 2,352,804 | A | 7/1944 | Schepmoes | |
| 2,770,717 | A | 11/1956 | Schwartz | |
| 3,248,533 | A * | 4/1966 | Mathis | 362/222 |
| 3,867,626 | A | 2/1975 | Wilson | |
| 4,045,665 | A * | 8/1977 | Williams et al. | 362/355 |
| D254,693 | S * | 4/1980 | Yahraus et al. | D26/123 |
| 4,247,884 | A * | 1/1981 | McJunkin et al. | 362/164 |
| 4,282,564 | A * | 8/1981 | McJunkin Jr. et al. | 362/217 |
| 4,816,969 | A | 3/1989 | Miller | |
| 4,998,188 | A | 3/1991 | Degelmann | |
| 4,999,754 | A * | 3/1991 | Gary | 362/237 |
| 5,351,172 | A * | 9/1994 | Attree et al. | 362/92 |
| D365,651 | S * | 12/1995 | Herst et al. | D26/77 |
| D383,238 | S | 9/1997 | Chen | |
| D386,278 | S | 11/1997 | Engle | |
| D397,480 | S * | 8/1998 | Herst et al. | D26/77 |
| D404,513 | S * | 1/1999 | Herst et al. | D26/77 |
| D411,030 | S | 6/1999 | Chen | |
| 6,247,828 | B1 * | 6/2001 | Herst | 362/217 |
| D469,711 | S | 2/2003 | Neufeglise | |
| 6,536,924 | B1 | 3/2003 | Segretto | |
| 6,582,103 | B1 | 6/2003 | Popovich | |

* cited by examiner

*Primary Examiner*—Sandra O'Shea
*Assistant Examiner*—Adam C. Rehm
(74) *Attorney, Agent, or Firm*—Henry L. Smith, Jr.

(57) ABSTRACT

An after-market shade for a strip light, typically containing several bare bulbs, either clear or frosted. The shade is a molded mainly one-piece translucent shade, or a translucent shade with two end caps for mounting. The shade is not attached to the fixture but to the wall, or possibly ceiling, on which the strip light is mounted. The shade is typically curved or half cylindrical. Translucent sheets with decorative patterns or colors may be mounted on the inside or outside of the shade to produce decorative effects and coordinate with room decor.

18 Claims, 7 Drawing Sheets

STRIP LIGHT SHADE

BACKGROUND

1. Field of Invention

The field of the Invention is after-market light shades designed to be placed over existing fixtures with bare electric bulbs.

2. Description of Prior Art

Over the years, a multitude of elongated light fixtures have been developed which are mounted on a wall or ceiling and which use bare incandescent bulbs or bare fluorescent bulbs. Also there are many such fixtures which incorporate, as part of the fixture, shades of many different designs and configurations. The Inventor of this Application is unaware of any after-market shade for a strip light containing bare incandescent or fluorescent bulbs, which can be easily mounted completely over the existing fixture and bulbs by direct attachment to the wall or ceiling.

U.S. Pat. No. 3,867,626, Feb. 18, 1975, to Wilson, discloses a soffit lighting unit for mounting over an existing light fixture. The device has numerous parts, some of which are complex. It presents a rather large, heavy and conspicuous appearance, and its shape, being generally rectangular, does not harmonize with the modern motifs associated with a strip light fixture. Its parts generally do not permit a great deal of light to escape. The various parts would take an ordinary person some time to properly assemble and position on a wall. It is generally designed to be mounted up against a ceiling, and is not adapted to be mounted over a light fixture some distance down from the ceiling, and certainly not over a light fixture vertically mounted perpendicular to the ceiling. For the latter fixture, most of its light would not be shaded, since the fixture of the above patent does not wrap around most of the light fixture with translucent plastic.

SUMMARY OF INVENTION

The Invention is an after-market shade or diffuser for an elongated light such as a strip light typically containing several bare bulbs, either clear or frosted. The shade is a generally half-cylindrical molded one-piece translucent or semi-transparent shade designed to be attached directly to a wall with screws or similar fasteners, or a translucent generally half-cylindrical shade with two end caps for mounting. The shade is not attached to the fixture but to the wall, or the ceiling, on which the strip light is mounted. As used in this Application, translucent means transmitting light but having a generally milky appearance so that the details of the bulbs and strip light fixture are not visible; semi-transparent means that the details of the bulbs and fixture are visible but their brightness is reduced.

Strip lights have typically been used in homes in the last 15–20 years in bathrooms or dressing rooms. Such strip lights contain several round bare bulbs, either clear or frosted. The strip is typically mounted on a wall parallel to the floor and a short distance down from the ceiling, although some are mounted vertically on a wall on both sides of a vanity mirror. The strip fixture itself is typically shiny silver or bronze. This fixture may provide a strong light over a bathroom sink, counter or vanity, but the light can be too bright and glaring in the eyes of a person. The Invention is an aftermarket molded shade which goes over the strip light and typically mounts to the wall the strip light is mounted on. The shade would typically be curved and generally half-cylindrical and could be made of several different translucent heat resistant plastics, including fiberglass containing plastic. Its shape could also be more rectangular or angular. Glass is another possible material for the shade. Several ventilation holes would typically be provided in the top of the shade to disperse the heat from the bulbs. The shade could optionally have a long opening on the top of the shade to allow more light to shine upward on the wall or ceiling. Also it could optionally have such an opening on the bottom to allow more light to shine downward on a sink or counter. Several mounting methods are possible including brackets screwed into the wall, where the shade hangs from or snaps over the brackets etc. Translucent sheets with decorative patterns and colors may be positioned inside the shade or over the outside to produce decorative effects and coordinate with room decor.

The purpose of the Invention is to offer consumers an affordable, decorative and functional option for upgrading their existing strip light fixture by covering the exposed light bulbs with a decorative shade or diffuser. The decorative, lightweight shade easily attaches to the wall with screws, which allows for easy install and removal. The shade can be offered in a variety of decorative colors, finishes, and styles, allowing for an aesthetic coordination with the existing interior design.

OBJECTS AND ADVANTAGES

The objects and advantages of the present Invention are:

1. To provide an after-market shade or diffuser which is easy to install over existing strip light fixture, requiring only 2–4 screws, depending on weight and length.
2. To provide a low cost shade, especially when compared to replacing the light fixture.
3. To provide a one-piece shade with is easy to install over an existing strip light fixture.
4. To provide an instant design and appearance upgrade without changing the light fixture.
5. To provide a shade which diffuses intense glare from exposed light bulbs
6. To provide a shade with decorative options, such as, colors and designs which can be easily installed and removed or changed.
7. To create a "finished" light fixture appearance.
8. To provide a shade which is very easy to remove in order to change light bulbs, as necessary.
9. To provide a shade which updates and transforms the appearance of a strip light fixture.
10. To provide a shade which hides dust on the bulbs and light fixture and is much easier to clean than cleaning the bare bulbs and fixture.
11. To provide a shade which is available in several different sculpted shapes, finishes, and styles to suit the taste of the user.
12. To provide a shade which diffuses the direct light from bare bulbs in a strip light, yet which may have an opening near the top to let stronger light bounce off the ceiling, or an opening near the bottom to let stronger light shine downward on a sink or counter surface below the light.

DRAWING FIGURES

FIG. 1 shows a version of the Invention with two separate end caps over the ends of the shades, where the end caps have screw holes for attaching the shade to the wall.

FIG. 2 is a detailed view of one version of the shade, a one-piece cylindrical version with four mounting arms. Also shown are four screw holes for inserting screws into the wall and from which the shade hangs without touching the strip light fixture. To manufacture the shade, it could be molded as one piece, or the half-cylindrical portion could be molded as one piece, and then mounting strips with screw holes, made of the same or similar plastic or metal, could be attached to the molded portion.

REFERENCE NUMERALS IN DRAWINGS

Figure 1:
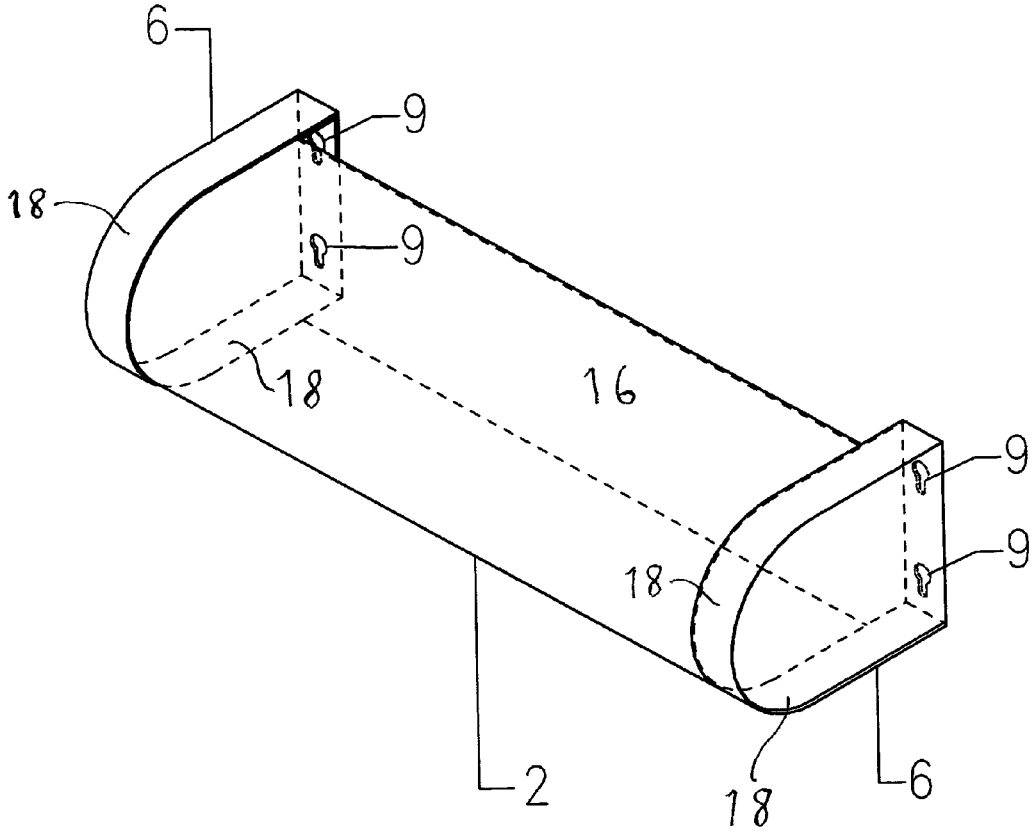

1 right end area
2 curved surface of half-cylinder
3 arms
4 left end area
5 mounting strips
6 end caps
7 stiffener bracket
8 stiffener strip
9 screw holes
10 rods
11 screw eyelets
12 shade
13 strip light fixture
14 strip light bulb
15 wall
16 back rectangular opening
17 cut out
18 flange
19 lower back straight edge
20 sheet

DETAILED DESCIPTION OF THE DRAWINGS

FIG. 1 shows a version of the Invention with curved generally half-cylindrical body of the Invention, curved surface 2 fitted with optional end caps 6. These end caps could be made of metal and opaque, or they could be separate pieces made of translucent plastic. Separate end caps may facilitate the molding of the device in three pieces instead of one. FIG. 1 also shows four screw holes 9 in the end caps 6 for mounting the device over an existing light fixture and into a wall. Other means for attaching the end caps to the wall would be knows to those skilled in the art. The fixture would not touch the existing strip light fixture. The Figure also shows back rectangular opening 16, end cap flanges 18, and screw holes 9.

Figure 2:
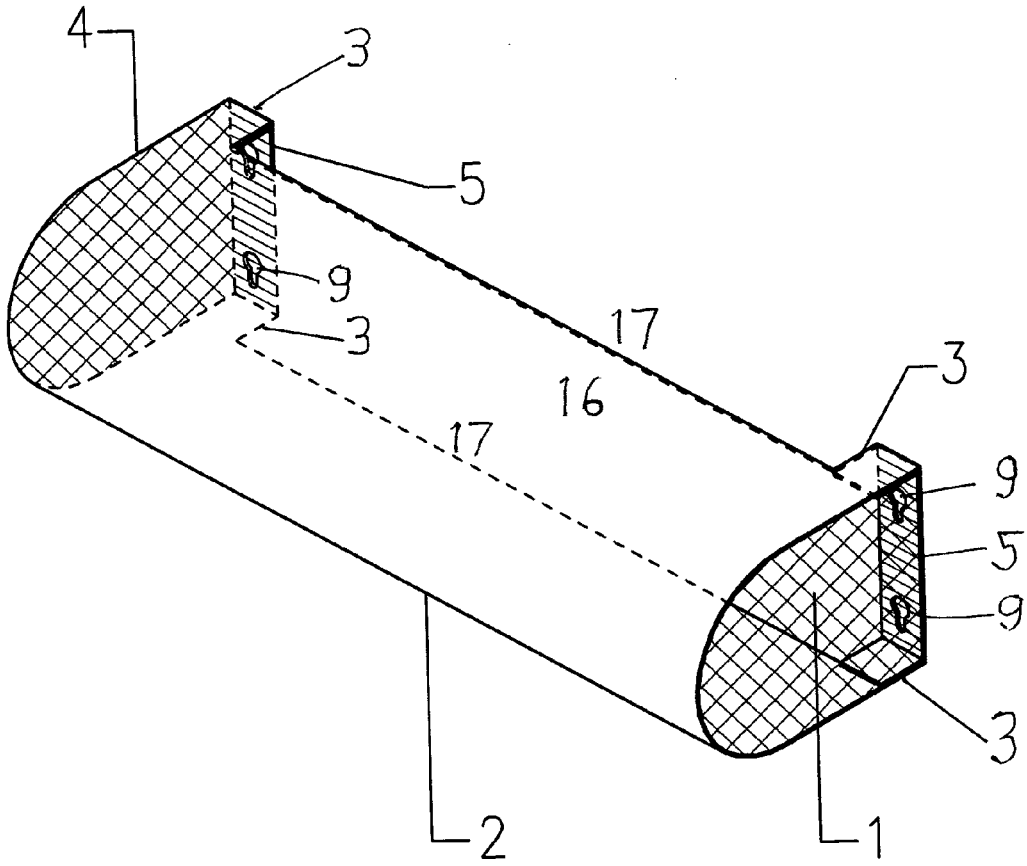
Figure 3:
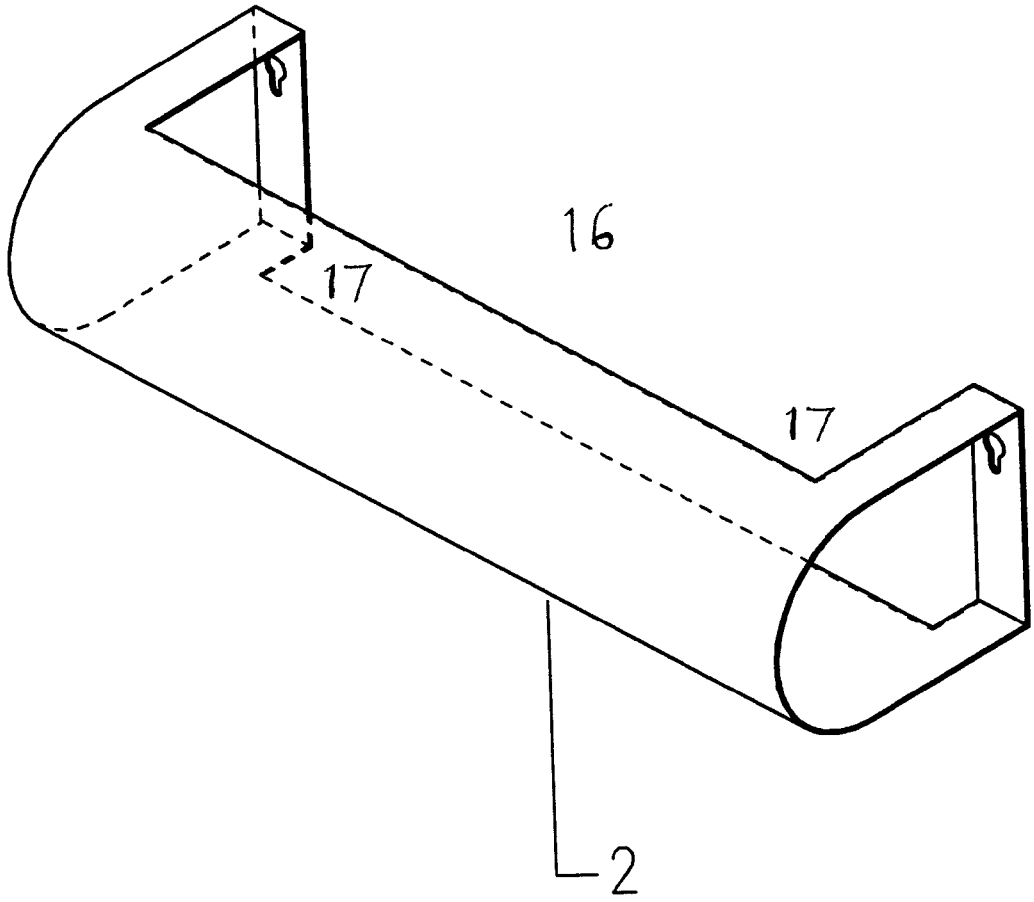
FIG. 3 shows a version of the Invention with a larger cut out area on the top to allow more heat to escape, and to allow light to bounce off the ceiling or wall near the shade.

FIG. 2 shows a molded one-piece version of the Invention where curved surface to 2 is all of one-piece with the left end area 4 and the right end area 1. Other parts of this unitary molded device include the arms 3 at each end and mounting strips 5 at each end. The arms 3 essentially create two long cut outs 17 in the top of the Invention to allow heat of the bulbs inside (not shown) to escape, and to allow more light from the bulbs to strike the ceiling above the fixture or the wall on which the fixture is mounted. The back rectangular opening 16 is also shown. Mounting strips 5 are attached to the rest of the shade in this version. Mounting strips 5 could be separate pieces attached to the wall separately with screws through screw holes 9, and in that case the shade arms 3 would snap over them for attachment to the wall. Other means for attaching the shade arms to the wall would be known to those skilled in the art FIG. 3 shows a version of the Invention with a rectangular cut out 17 in the top of a curved surface 2 to allow more light to escape from the fixture and be reflected from the ceiling or wall. Also shown is back rectangular opening 16

Figure 4:
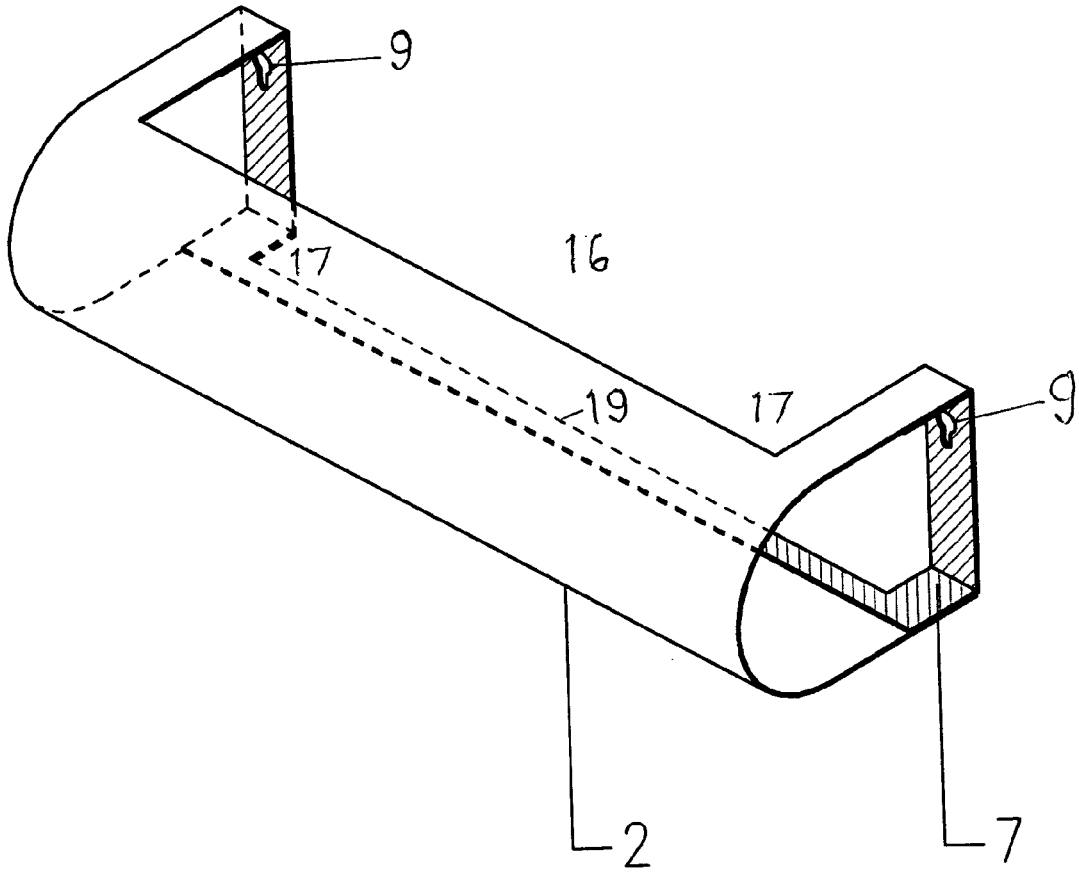
FIG. 4 shows a version of the shade with an extra material (e.g. metal or another layer of plastic) attached to the length of the bottom cutout to prevent sagging of longer shades, and to the mounting strips (with screw holes) to strengthen that area as well.

FIG. 4 shows a version of the Invention with stiffener bracket 7 applied to the curved surface 2. This stiffener bracket would run along the lower back straight edge 19 of curved surface 2 along most of the length of the fixture in order to stiffen the fixture and prevent it from sagging. This stiffener bracket 7 also comprises a stiffener for mounting surface 5, and contains screw holes 9. The stiffener bracket could be made of metal attached to the unitary molded curved surface 2, or it could simply be an extra layer of stiff plastic attached as shown in FIG. 4 to provide additional strength to the fixture. Cutouts 17 and back rectangular opening 16 are shown.

Figure 5:
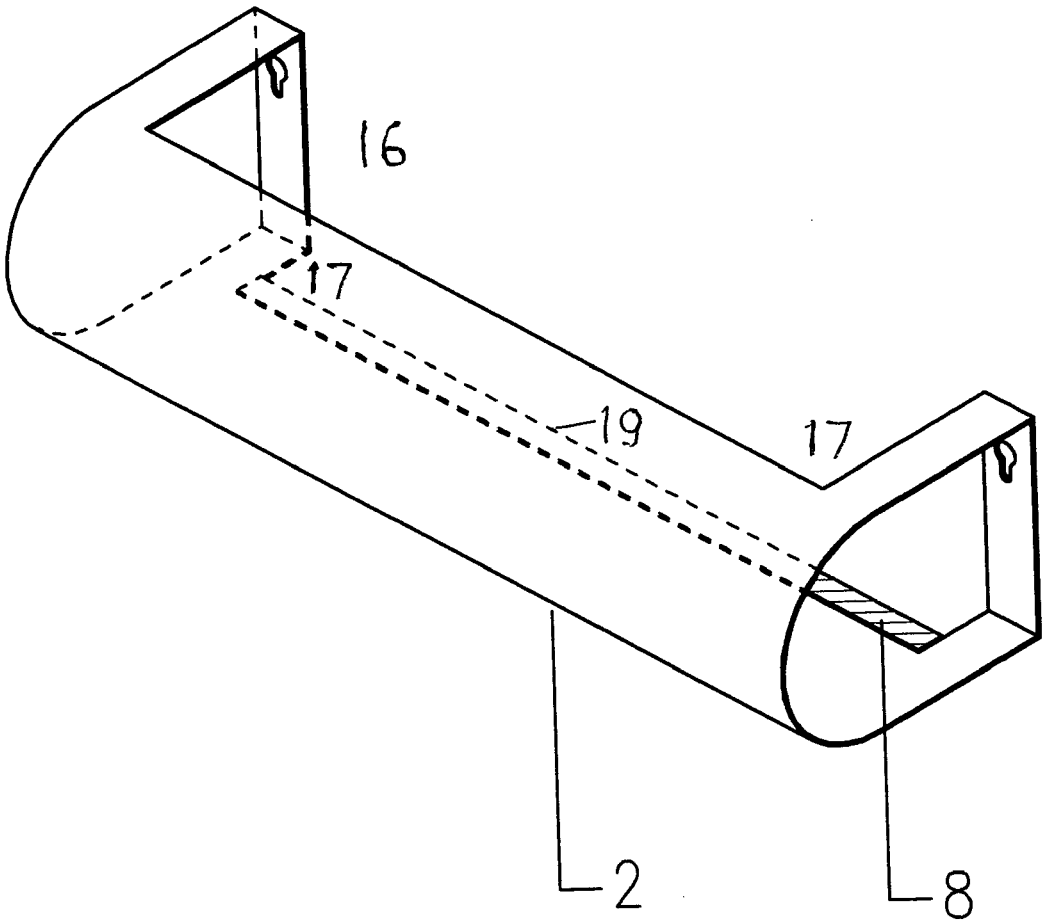
FIG. 5 shows a stiffening strip of extra material (e.g. metal or plastic) applied only along the lower cut out edge to prevent sagging of longer shades.

FIG. 5 shows a version of the fixture with a generally rectangular stiffener strip 8 attached to the lower back straight edge of curved surfaces near the wall, along most of the length of the fixture. Again, this stiffener strip could be made of metal or translucent plastic.

Figure 6:
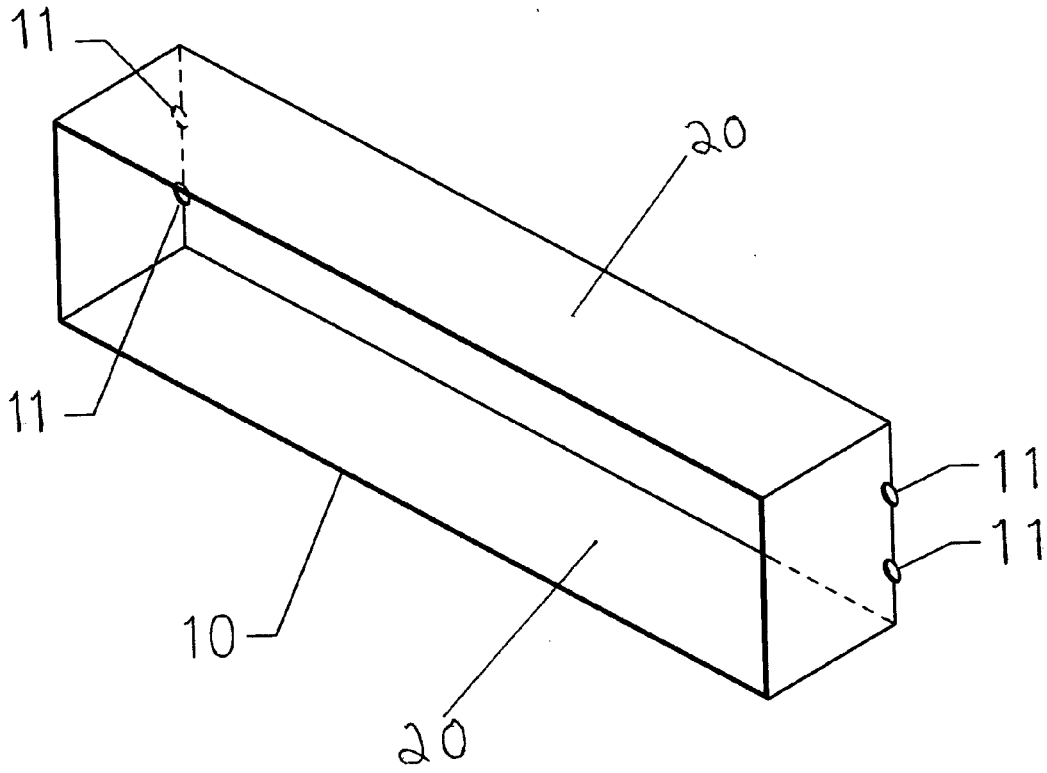
FIG. 6 shows an alternate version of the Invention comprising a generally rectangular open cage made of metal rods, and screw eyelets for mounting on the wall. Over this open cage structure, translucent sheets of plastic can be attached to form the shade.

FIG. 6 shows an alternate version of the Invention comprising a generally open rectangular box made of rods 10 typically of metal or strong plastic. The box would be attached to the wall over an existing strip light fixture by means of screws which pass through screw eyelets 11 or other rod attachment means known to those skilled in the art, and into the wall on which the light fixture and the Invention are mounted. Various translucent plastic sheets 20 could be placed on some or all of the surfaces of this rectangular box which do not touch the wall, thereby shading the light fixture contained within the rectangular box. Various decorative colors or patterns could be included on the translucent plastic panels.

Figure 7:
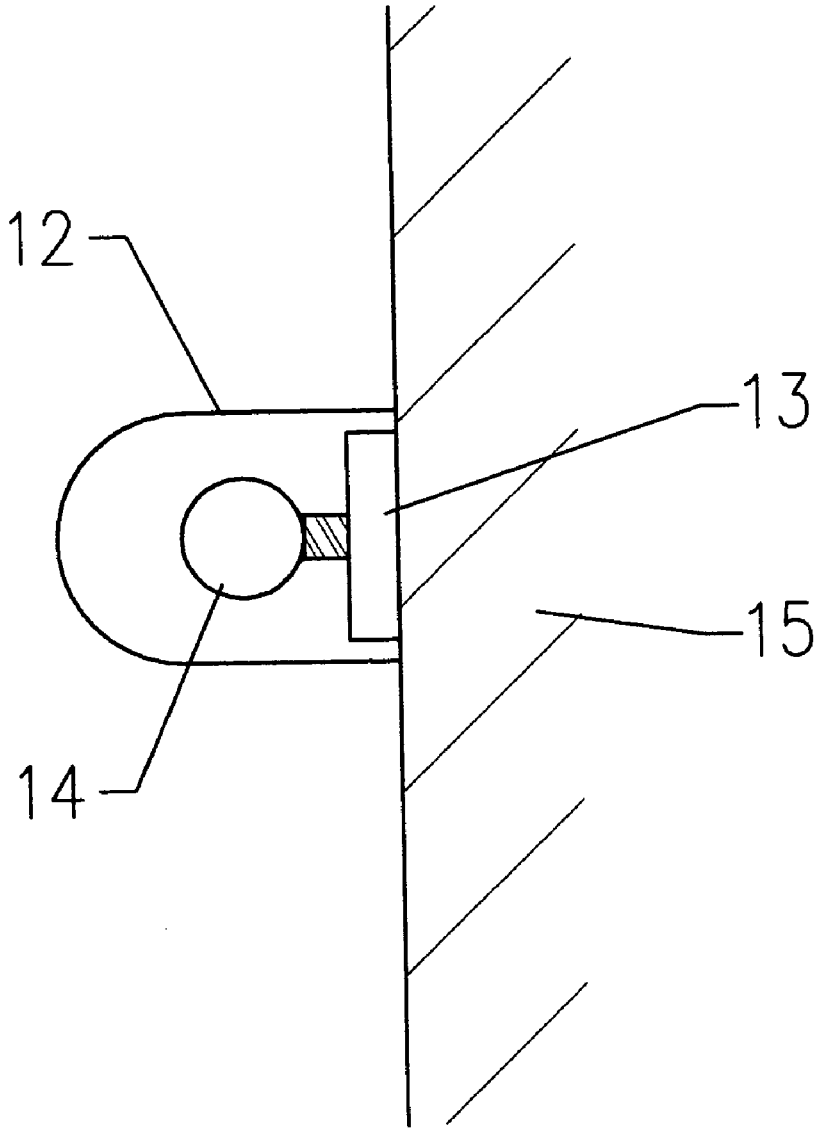
FIG. 7 shows a cross section of a wall with a strip light mounted on it. A bare bulb is also shown as well as a cross section of the shade mounted over the strip light and attached to the wall.

FIG. 7 is a cross sectional view of the wall 15 on which is mounted an existing strip light fixture 13 (not part of the Invention), containing a bear strip light bulb 14. The shade of the present Invention is shown in cross-section as a C-shaped shade 12 which is mounted on the wall and generally does not contact the existing strip light fixture 13. Because the shade 12 is open enough and large enough, it is adapted to fit over a wide variety of strip light fixtures 13.

Description—Preferred Embodiment

The preferred embodiment is a molded piece of translucent plastic with a generally half-cylindrical curved shape, sized and shaped to fit over a strip light fixture attached to a wall, without touching the fixture or its bulbs. The preferred embodiment attaches to the wall near the fixture by means of 2 or 4 screws placed through mounting strips in the two ends of the shade and into the wall. Alternatively, the arms on both ends of the molded shade could snap over, or otherwise engage, two rectangular mounting strips mounted vertically on the wall with screws, and positioned parallel to the short ends of the strip light. The preferred embodiment would have several ventilation holes above the bulbs to dissipate heat. It may also have a cut out along the top of the shade, and possibly also along the bottom of the shade, to allow undiffused direct light from the bulbs to shine on the ceiling, or counter beneath the strip light fixture.

Operation of the Invention

The shade is mounted over a strip light fixture attached to a wall, by placing the curved molded shade over the fixture without touching the fixture or the bulbs. The shade is held in place by two or four screws passing through holes in two mounting strips, and into the wall. Alternatively the arms on the two ends of the shade could hang from, snap over, or otherwise engage two mounting strips parallel to the ends of the strip light and secured to the wall by screws. The shade can easily be removed from the wall for cleaning, and for cleaning the bulbs and fixture inside.

Tests

The following tests were conducted in the process of designing the strip light shade. January, 2004 A full size metal frame with paper overlay was created to test the general design appearance, size, installation methods, and appropriateness of materials. February, 2004 Miniature paper prototypes were created to illustrate variations on basic design, shape and form.

Feb. 28, 2004 A full size paper prototype was created to test design, appearance, size, and shape.

Mar. 13, 2004 A full size plastic prototype was created out of a sheet of plastic to test: design, appearance, size, shape and appropriateness of plastic for a possible material. Mar. 20, 2004 A full size molded prototype (#1) was created out of plastic and fiberglass to test: appearance, fit and finish, ease of installation, heat resistance, durability and appropriateness of materials.

Apr. 12, 2004 A full size molded prototype (#2) was created out of plastic and fiberglass to test: design variations, appearance, fit and finish, ease of installation, heat resistance, durability and appropriateness of materials.

Apr. 17, 2004 Temperature tests were conducted on prototype #1 and #2. For the test, the prototypes were installed and the light bulbs were left on for 12 hours, during which time, the air temperature was recorded.

Additional Embodiments

The one-piece shade could be provided with various decorative finishes or patterns or lines or ridges molded into the plastic of the shade. Transparent films with colors or designs may be added to the inside or outside surfaces of the shade to produce many different decorative effects. The films may be supplied with releasable adhesives so that they can be easily changed.

The one-piece molded shade or diffuser may have a series of ventilation holes near the top surface to dissipate the heat of the bulbs inside. The shade could have an opening, similar to a slit, along most of its top portion to allow undiffused light to bounce off the ceiling, and a similar opening along most of its bottom portion to allow direct light from the bulbs to fall on a sink or counter area, while reducing and diffusing the light from the bulbs which falls on the eyes of a person in the room near the fixture. If the fixture it is to be mounted over a strip light on a wall which is perpendicular to the ceiling, then ventilation holds would be desirable in the right end area 1 and left end area 4 to allow heat to escape vertically when the shade is mounted over a fixture which is perpendicular to the ceiling. These ventilation holes would be obvious to a person skilled in the art and could be formed as part of the original process for molding the shade 12, or they could be formed by drilling holes into the molded shade at the appropriate places and with the appropriate sized openings.

Alternative Embodiments

An alternative embodiment may involve manufacturing the finished shade in several pieces depending on preferred fabrication methods, and assembly of the shade prior to installation. For example, the end caps may be manufactured as separate pieces and then glued, screwed, or otherwise attached to the formed shade prior to installation. Additionally, the brackets or braces on the shade which contain screw holes for installation, could be manufactured as separate pieces, and then glued or otherwise attached to the formed shade prior to installation.

An alternative embodiment may be creating the shade from a open rectangular box made of rods, and then attaching materials, such as cloth, paper, wood products, rattan or similar materials to the frame for a finished shade. The shade material could also be treated with a heat resistant or flame retardant finish, as necessary.

CONCLUSIONS, RAMIFICATIONS AND SCOPE

A number of changes are possible to the parts and materials described above while still remaining within the scope and spirit of the Invention. The specifics about the form of the Invention described in this Application are not intended to be limiting in scope. The scope of the Invention is to be determined by the claims and their legal equivalents, not the examples given above.

I claim:

1. A one-piece molded light shade sized and shaped to fit over an existing elongated light fixture attached to a building wall, and attached directly to the building wall to which the fixture is attached, comprising:

(a) a translucent or semi-transparent piece of moldable or stampable material having a general shape of a half-cylinder with a back rectangular opening substantially defining a rectangle the plane of which is parallel to the long axis of the half-cylinder, and having two closed end areas substantially in the shape of a semicircle, at each end of the half-cylinder, the planes of which are substantially perpendicular to the long axis of the half-cylinder, and (b) one or more arms at each end of the half-cylinder attached to or extending from the half-cylinder, attaching the half-cylinder directly to a building wall, wherein neither the shade as a whole, the half cylinder, nor the arms are attached to the existing elongated light fixture, and whereby the half-cylinder is placed over an existing elongated fixture, which is attached to wall, and is itself attached directly to the building wall by the arms and whereby the arms create a gap for heat and light to escape.

2. A molded light shade sized and shaped to fit over an existing elongated light fixture attached to a building wall, and attached directly to the building wall to which the fixture is attached, comprising:

(a) a translucent or semi-transparent piece of moldable or stampable material having a general shape of a half-cylinder with a back rectangular opening substantially defining a rectangle the plane of which is parallel to the long axis of the half-cylinder, and having two open end areas substantially in the shape of a semicircle at each end of the half-cylinder, the planes of which are substantially perpendicular to the long axis of the half-cylinder, and (b) two end caps substantially in the shape of two semicircles, and further comprising a flange perpendicular to the plane of the semicircles, and extending around the half perimeter of the semicircles, and along the straight edge of the semicircles corresponding to said back rectangular opening, and (c) means for attaching the end caps directly to a building wall, wherein said means is attached to or is part of said flange along said straight edge, and wherein said means create a gap for heat and light to escape, wherein neither the shade as a whole, the half cylinder, nor the arms are attached to the existing elongated light fixture, and whereby said two end caps are positioned to close the two open end areas of said half-cylinder and thereby to secure said half-cylinder between them, and whereby the half-cylinder is held in position over and covering an elongated lighting fixture.

3. The shade of claim 1, wherein the means for attaching in 1(*b*) comprises: (a) two mounting strips of plastic or metal mounted directly on the building wall and adapted to snap into or otherwise engage the arms, or (b) two mounting strips of plastic or metal attached to the arms, and containing screw holes through which screws or other fasteners can secure the mounting strips and shade directly to the building wall.

4. The shade of claim 1, further comprising one or more substantially rectangular cut-outs extending from the back rectangular opening and generally perpendicular to the opening, and into the upper or lower portions, or both, of the curved surface of the half-cylinder surface, adjacent thereto, whereby heat and direct light may be emitted from an elongated fixture inside the shade.

5. The shade of claim 2, further comprising one or more substantially rectangular cut-outs extending from the back rectangular opening and generally perpendicular to the opening, and into the upper or lower portions, or both, of the curved surface of the half cylinder surface, adjacent thereto, whereby heat and direct light may be emitted from an elongated fixture inside the shade.

6. The shade of claim 4, further comprising a stiffener strip attached to the half cylinder curved surface along the lower back straight edge which comprises the lower long side of the back rectangular opening or cut out, whereby the shade is prevented from sagging between its attachment points directly to a building wall.

7. The shade of claim 5, further comprising a stiffener strip attached to the half cylinder curved surface along the lower back straight edge which comprises the lower long side of the back rectangular opening or cut out, whereby the shade is prevented from sagging between its attachment points to a wall.

8. The shade of claim 1, further comprising a stiffener bracket comprising a stiffener strip attached to the half cylinder curved surface along the lower back straight edge which comprises the lower long side of the back rectangular opening or cut out, and two substantially rectangular strips attached to said stiffener strip wherein said rectangular strips are attached to the half cylinder curved surface and extend substantially parallel to the two short ends of the back rectangular opening.

9. The shade of claim 1, further comprising colors or designs, or both, applied to the surfaces of the shade.

10. The shade of claim 2, further comprising colors or designs, or both, applied to the surfaces of the shade.

11. The shade of claim 3, further comprising colors or designs, or both, applied to the surfaces of the shade.

12. The shade of claim 4, further comprising colors or designs, or both, applied to the surfaces of the shade.

13. The shade of claim 5, further comprising colors or designs, or both, applied to the surfaces of the shade.

14. The shade of claim 6, further comprising colors or designs, or both, applied to the surfaces of the shade.

15. The shade of claim 7, further comprising colors or designs, or both, applied to the surfaces of the shade.

16. The shade of claim 8, further comprising colors or design, or both, applied to the surfaces of the shade.

17. The shade of claim 1, further comprising a stiffener strip attached to the half cylinder curved surface along a lower back straight edge which comprises the lower long side of the back rectangular opening or cut out, whereby the shade is prevented from sagging between its attachment points to the wall.

18. The shade of claim 2, further comprising a stiffener strip attached to the half cylinder curved surface along a lower back straight edge which comprises one long side of the back rectangular opening or cut out, whereby the shade is prevented from sagging between its attachment points directly to the building wall.

* * * * *